United States Patent [19]

Hill

[11] Patent Number: 4,955,812

[45] Date of Patent: Sep. 11, 1990

[54] VIDEO TARGET TRAINING APPARATUS FOR MARKSMEN, AND METHOD

[76] Inventor: Banford R. Hill, 935 S.W. 19th Ave., Portland, Oreg. 97209

[21] Appl. No.: 228,040

[22] Filed: Aug. 4, 1988

[51] Int. Cl.[5] ..... F41F 27/00

[52] U.S. Cl. ..... 434/16; 434/18; 434/19; 434/20; 213/314

[58] Field of Search ..... 434/16, 17, 18, 19, 434/20; 273/310, 311, 312, 313, 317

[56] References Cited

U.S. PATENT DOCUMENTS

| | | | |
|---|---|---|---|
| 1,277,932 | 10/1918 | Hollifield | 434/19 |
| 2,353,516 | 9/1942 | Socharczewski | 434/19 |
| 4,534,735 | 8/1985 | Allard | 434/20 |
| 4,619,616 | 10/1986 | Clarke | 434/19 |
| 4,804,325 | 2/1989 | Willits | 434/19 |
| 4,812,122 | 3/1989 | Mueller | 434/18 |
| 4,813,682 | 3/1989 | Okada | 434/20 |

OTHER PUBLICATIONS 11-87 Popular Science Magazine, p. 126.

*Primary Examiner*—William H. Grieb
*Assistant Examiner*—Dean Small

[57] ABSTRACT

A gun-resembling member has a stock, a barrel-like portion, and a trigger. Such gun is used with a target and has a front sight on the barrel-like portion together with an optical system which includes a rear sight. A target image from the two sights is reflected by the optical system to a video camera on the gun, and such camera is in circuit with a computer system and visual monitors capable of displaying and recording a target image at the instant of firing. Windage adjustments are included on the gun-resembling member and in the complete syste. A powered plunger is provided on the target whereby when the gun is held up to the target for sighting, the plunger engages the gun and produces a simulated recoil. The gun also has apparatus engageable by the plunger for recocking the trigger when such recoil is produced.

10 Claims, 2 Drawing Sheets

VIDEO TARGET TRAINING APPARATUS FOR MARKSMEN, AND METHOD

BACKGROUND OF THE INVENTION

This invention relates to new and useful improvements in marksman target training apparatus, and to a method of accomplishing the same.

Target training procedures for marksmen have been accomplished with live ammunition at targets of specific yardage in a range area. One drawback of this procedure is the substantial cost of the hundreds of rounds of ammunition used. Other drawbacks also are that firing ranges require considerable space, they generally can be used only in daylight, and are not readily accessible. Furthermore, for hi-power weapons, live ammunition requires that noise protectors for the ears be worn. Simulated guns have been proposed utilizing laser beams wherein laser beam emitting structure is strapped to a weapon-resembling member and the beam therefrom is picked up on a target by a video camera and displayed on a TV monitor. The information obtained from the laser beam approach does not lend itself to computer analysis and control. Also, laser beams do not adapt to windage and range modifications or computer print-outs of an entire match summary. Further, a range is still needed for the laser method. Further yet, such simulated practice apparatus also has disadvantages in that it does not produce all the desired features generally desired by a marksman and especially for a marksman who wishes to train with a military-type rifle. That is, the gun used in the laser approach is not of semirepeating structure, it does not recoil, and it does not produce any appreciable audible sound when firing. Target practice shooters have also been known to dry fire at a dot pinned to the wall and then guess at the results. Such practice is not realistic and furthermore is not capable of showing accuracy and of keeping progress records.

SUMMARY OF THE INVENTION

According to the present invention and forming primary objectives thereof, a simulated video target training apparatus, and method, are provided which resemble actual gun range target practice and which are capable of recording accuracy in firing.

Another object of the invention is to provide a simulated video target training apparatus including sighting means on a gun-resembling member that use a simulated target but give the impression of actual target firing conditions. The apparatus also includes recoil and audible conditions when the trigger is pulled.

Yet another object of the invention is to provide a method and apparatus for target training that utilize a monitor display of a video pickup of a target line of sight on a gun resembling member and also that utilize a computer system capable of storing and displaying a graphic analysis of the video image to determine the impact points of theoretically fired bullets.

Still another object is to provide a target training and computer system of the type described that includes windage and elevation adjustment means on the gun resembling member which are pre-set on the computer for training the marksman to adjust for windage, and elevation.

In carrying out the objectives of the invention, a gun-resembling member is provided which has a stock or handle and a barrel-like portion and trigger means similar to a military target practice gun. A front sight is provided on the barrel-like portion and an optical system rear sight is provided on the barrel-like portion above the trigger. Means in the optical system reflect a simulated target image to a video camera supported on the stock. The video camera is in circuit with a first TV monitor which displays the target image. The camera is also in circuit with a programmed computer which produces a graphic analysis of the points of impact of theoretically fired bullets and displays them on a second monitor. Encoder means are provided on the gun resembling member which can be adjusted to compensate for windage settings on the computer. The camera may be embedded in the stock of the gun. Also forming a part of the invention is an elongated rod which extends through the bore of the gun and which has a forward projecting end arranged to be struck by powered plunger means at the simulated target. In operation, the gun is aimed at the simulated target in close association therewith, and upon pulling the trigger the powered plunger means engages the elongated rod and produces a recoil which simulates the recoil of a firearm. Such plunger in engaging the rod also recocks the trigger and at the same time the computer generates a non-harmful audible firing sound.

The invention will be better understood and additional objects and advantages will become apparent from the following description taken in connection with the accompanying drawings.

DETAILED DESCRIPTION OF A PREFERRED EMBODIMENT

Figure 1:
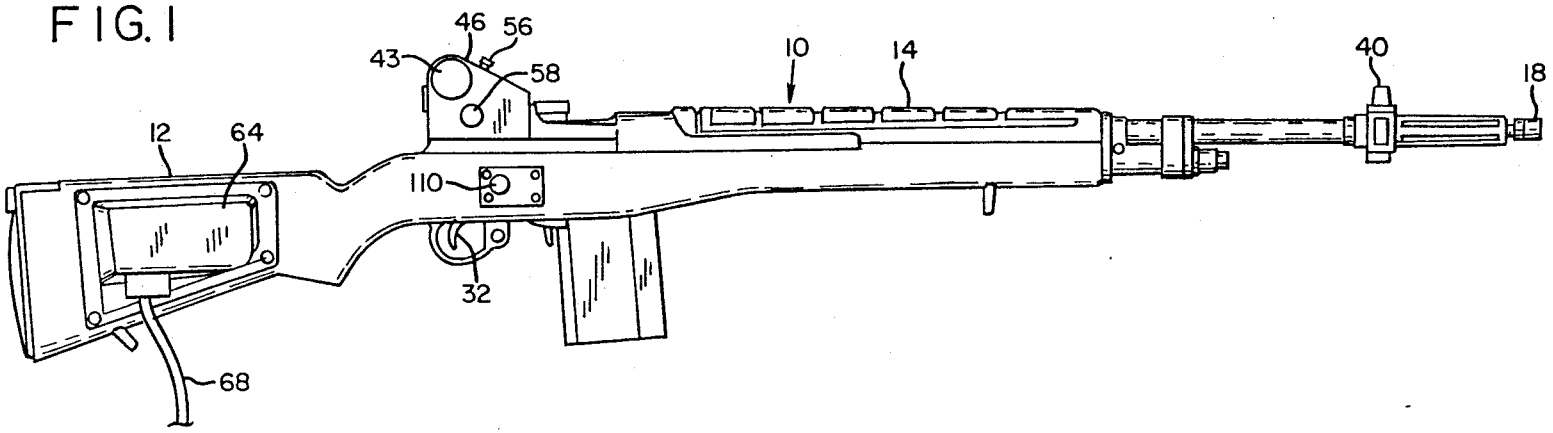
FIG. 1 is a side elevational view of a gun-resembling member embodying features of the instant invention.

With particular reference to the drawings and first to FIGS. 1 and 2, the invention will be described in connection with a gun-resembling member 10 such as a rifle resembling member. It is to be understood, however, that the member 10 may take other forms, such as a pistol. In connection with describing the instant invention and a preferred form, the member 10 assumes the shape of a conventional military training rifle.

The member 10 illustrated has a stock portion 12 and a barrel portion 14. Slidably supported in the bore of the barrel portion is an elongated rod 16 that projects from the front of the barrel. The rod 16 terminates at the front in a shock absorber abutment end 18 and the rear thereof comprises an enlargement 20 similar to a rifle bolt mechanism. The rod 16 passes through a stop 22 in the barrel against which the bolt is urged by a tension spring 24 connected between the barrel and the bolt.

Figure 2:
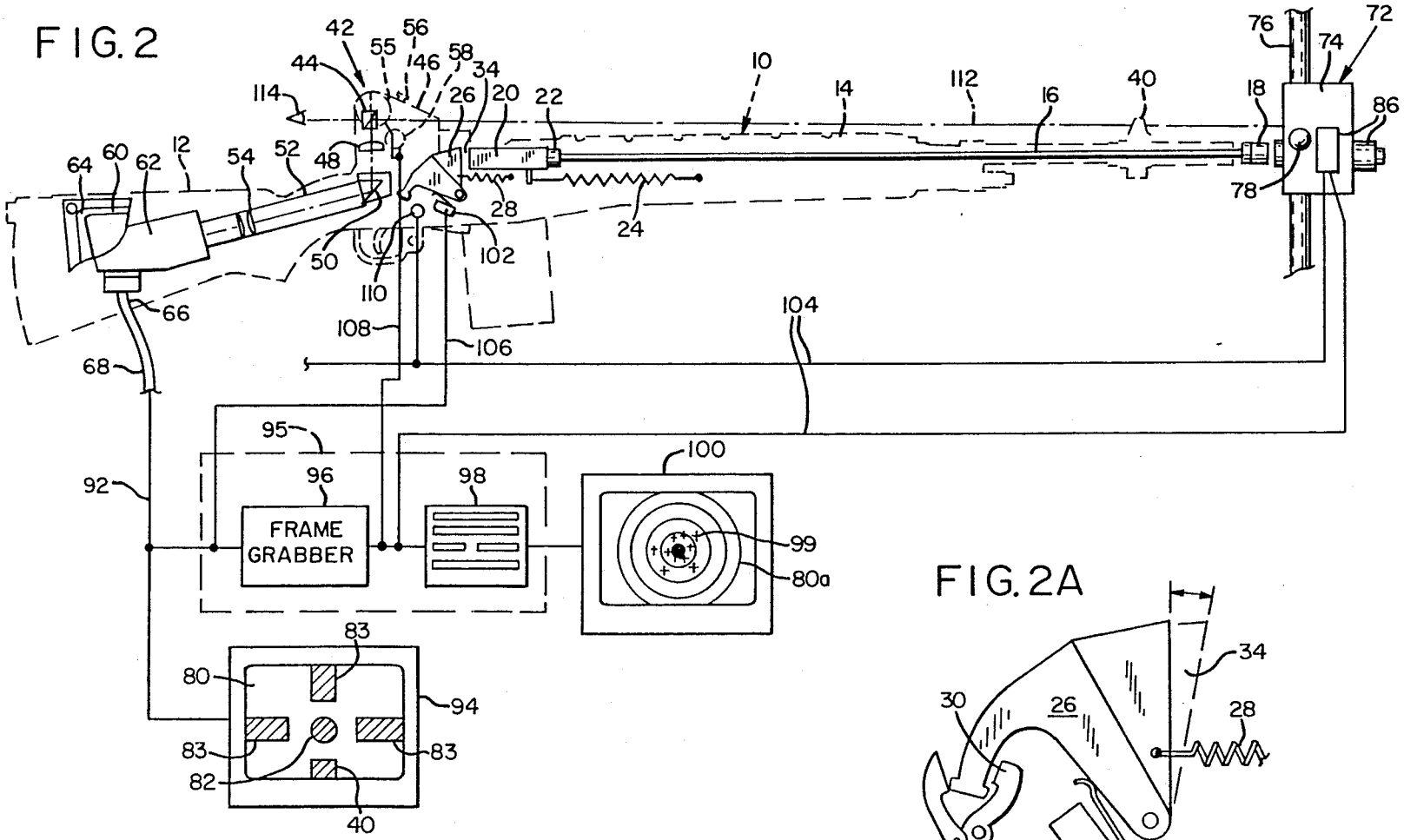
FIG. 2 is a side elevational view of a target and internal structure associated with the gun-resembling member, the gun resembling member being shown in broken lines.
Figure 2A:
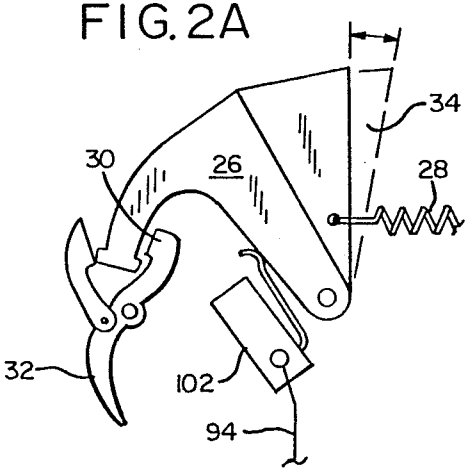
FIG. 2A is an enlarged detail view of trigger mechanism.

Bolt 20 is associated with a trigger mechanism having a hammer-like lever 26, best seen in FIG. 2A, urged in a forward pivotal movement by a tension spring 28 connected between the lever and barrel portion. Lever 26 is associated with catch means 30 of a trigger 32 in a conventional arrangement such that upon rearward pivoting of the lever 26 it will be automatically engaged and held by the catch means but will be allowed to travel forwardly upon pulling the trigger 32. In operation, and as will be more fully understood hereinafter, the hammer lever 26 is arranged to be cocked by rear movement of the rod 16 and the bolt 20. After cocking the hammer lever 26 by its rear movement, the bolt will leave the lever and move a short distance forwardly to its stop 22. A small space 34 thus occurs between the lever 26 and the bolt 20. Upon pulling the trigger, hammer lever 26 pivots forwardly under the tension of spring 28 into abutment with the bolt. FIGS. 2 and 2A show the hammer in cocked position.

Sighting means associated with the gun 10 comprises a conventional front sight or post 40 on the barrel portion 14 and an optical system 42 which takes the place of the usual rear sight. The optical system 42 comprises a beam splitter prism 44 in a suitable housing 46 and an achromat lens 48 also disposed in the housing 46. The optical system further includes a prism 50 mounted in and aligned with an angular passageway 52 in the stock. This passageway also has a negative rear lens element mounted therein.

The rear sight 42 includes an encoder 55 on each side, one to adjust for windings and the other to adjust for elevation, arranged to feed digital signals into a programmed computer to adjust for windage and elevation as will be described hereinafter. The purpose of such encoders is analogous to the sight adjustment knobs that exist on conventional target rifle sights. Each encoder has a reset button 56 to return the encoder to zero. Also, a side push button 58 is provided for correcting the graphic image center lines on a monitor, also to be described.

Passageway 52 communicates with a recess 60 in the stock arranged to receive a video camera 62 of conventional construction held in alignment with the passageway 52 and arranged to record the image which appears in the optical system. Recess 60 has a removable cover plate 64 for fully enclosing and protecting the camera. A bottom opening 66 is provided for the camera cord 68 for incorporating the camera in a circuit with monitors and computer means, to be described.

Figure 4:
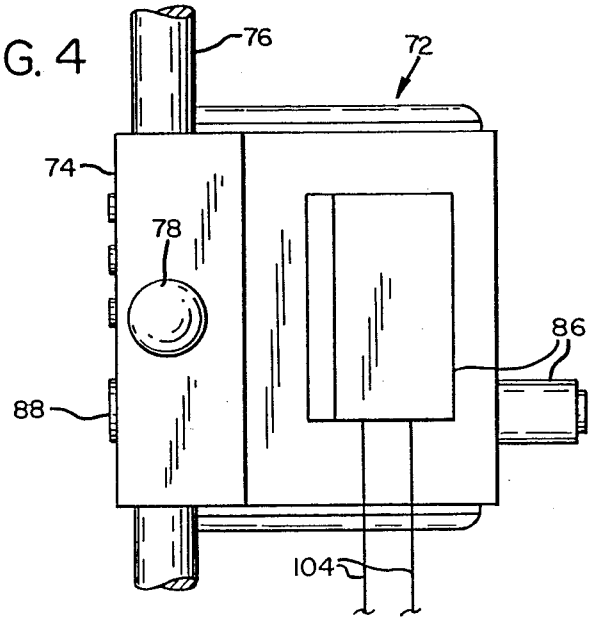
FIG. 4 is a side view of the target.
Figure 3:
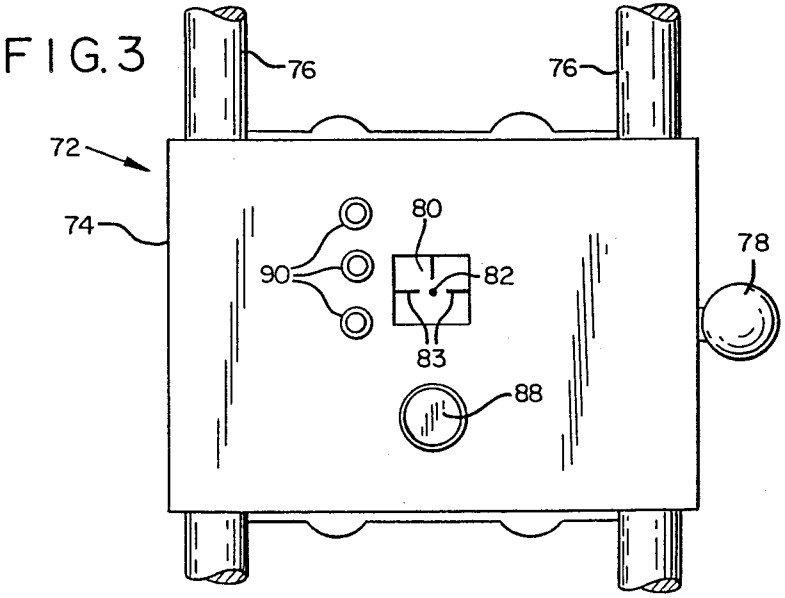
FIG. 3 is a face view of a simulated target used with the instant invention.

With particular reference to FIGS. 2, 3 and 4, the present practice apparatus is utilized at close range, namely, an inch or two, with a target mechanism 72 including a housing 74 mounted on an upright stand 76, or other suitable support, and having clamp means 78 or the like which allow vertical positioning of the housing. The stand is of a height which allows target adjustment to any position of the marksman from prone to standing.

The target housing 74 includes a simulated target 80 having a suitable aiming point 82 such as a bull's eye. Coordinates 83 are also provided in the target which are used by a computer to determine center lines. In a preferred arrangement, the target 80 comprises a window that is illuminated by suitable backing lights, not shown. Target mechanism 72 also includes a solenoid switch actuated, fluid or solenoid operated plunger mechanism 86 having a head portion 88 projecting a short distance through the front of the target mechanism 72 and arranged upon activation of the plunger mechanism to thrust forward a small distance such as two inches. Plunger head 88 projects from the housing adjacent to and vertically below the target 80, whereby with the gun 10 sighted in on the simulated target 80 and held at close range, the plunger mechanism 86 will strike the end of rod 16 to produce a simulated recoil and to move the rod rearwardly to cause the bolt 20 to engage the hammer lever 26 and recock the trigger mechanism.

Target 72 may have status lights 90 designating conditions in the process of target practice such as shoot, wait, scoring interval. Such status lights are suitably energized and controlled by conventional mechanism.

Also associated with the invention is a monitoring computer and video system showing and recording the accuracy at which the marksman shoots.

Such computer and monitoring system includes a circuit 92, FIG. 2, leading to a TV or other visual monitor 94. Monitor 94 displays the continual output of the camera and comprises the image of the front sight 40 and simulated target 80. This monitor allows visual inspection of aiming accuracy by another person if desired. Circuit 92 also leads to a frame grabber 96 and a computer 98. Frame grabber 96 digitizes single frames of the video image, in a conventional manner, and, through suitable software programmed into the computer 98, the program produces an analysis of the target picture on monitor 94 and a graphic image of impact points 99 on a second monitor 100. Monitor 100 also displays an actual target **80*a* and thus shows the position of impact points 99 on the target for each shot. The second monitor displays selected program commands, scoring data and an operator's instruction manual. When different ranges (distances) are selected in the program, the monitor 100 displays computer generated target pictures 80*a* of actual targets used for those particular ranges. The status lights may be controlled by the computer 98** and furthermore, the computer is programmed to record and display other data such as number of shots fired, windage, range, etc.

The fluid or solenoid operated plunger 86 is in a circuit 104 leading from the output side of frame grabber 96 wherein the plunger 86 is caused to be activated each time that the frame grabber digitizes a single frame image. A microswitch 102 is mounted on the stock adjacent to the hammer lever 26. It is normally open and has circuit connection 106 with the frame grabber to cause simultaneous activation of the frame grabber and the powered plunger 86 each time the trigger is pulled and the hammer lever 26 springs forwardly.

Circuit means 108 electrically connect encoders 55, reset button 56 and image correcting button 58 into the computer 98.

An auxiliary switch 110 with an exteriorly protruding actuating means, such as a push button, is mounted on the stock adjacent to the trigger and is in circuit 104 with the fluid or solenoid operated plunger 86 but in by-pass relation to the circuit 92. Upon manually closing this switch, the plunger 86 can be operated to bypass the computer for a purpose to be described.

OPERATION

In the use of the present practice apparatus, the target housing 74 is first positioned to the desired height on the stand. The marksman then aims at the bullseye 82 on the simulated target 80. In doing this, the marksman holds the gun up immediately adjacent or next to the target housing, for example, an inch, and sights in on the simulated target. With the particular location of the solenoid operated plunger mechanism 86 in the target housing, plunger head 88 will strike the end 18 of the rod 16 when the trigger is pulled for producing a recoil in the gun and also for moving the rod 16 rearwardly an amount sufficient to recock the trigger.

In the aiming process, a line of sight 112 is established between the marksman's eye 114, the bullseye 82, the front sight 40, and the beam splitter prism 44 which serves as the usual rear sight. When aimed at the target, four points, comprising points 82, 40, 44 and the marksman's eye 114 are along the common line of sight 112, the optical beam splitter 44 being arranged to reflect 50% of the intensity of the simulated target image as well as the front sight 40 image downward to the video camera. The remaining 50% of the intensity of the simulated target image plus the front sight 40 image is transmitted along the line of sight to the eye. Therefore the eye and video camera see exactly the same picture. Monitor 94 carries a continuous display of the camera output and this display can be viewed by others, such as instructors, at a remote location if desired. When the trigger is pulled, the hammer lever 26 pivots forwardly to allow the switch 102 to close the circuit to the frame grabber 96 which in turn causes a single frame to be stored in the computer 98 and analyzed and displayed as an impact point 99 on the computer generated target 80a of monitor 100. Computer 98 retains target shots on the monitor 100 for multiple referenced display, as shown.

Thus, marksmen can determine their proficiency or be graded, etc.

Trajectory influencing factors can be programmed into the computer, such as wind speed, wind direction, elevation (range distance), temperature and humidity, and thus with these factors known to the marksman, he must adjust the encoders to nullify these factors and thus their influence on the theoretical bullet's trajectory whereby to achieve predictable placement of the impact points on the monitor 100. Reset buttons 56 are pressed if and when the decoders are to be returned to zero. Command input to the computer program is also associated with the button 58 which when pressed calls for a computer measurement, or calibration, of the target elements 82, 83 and the front side 40 of the video image, in order to establish the exact center of element 82, the center lines of 83, and the vertical center line and the height of the horizontal edge of the front sight 40. These points and lines provide reference coordinates for the computer program to use to determine the impact point from a given frame of video image of the sight picture. Button 58 gives the marksman the ability to calibrate the program during a string of shots to insure against any change of reference points and lines which may have occurred due to physical stress, temperature, humidity, static, etc.

A second and simultaneous function of the switch 102 is to activate the solenoid operated plunger 86. Thus, simultaneous with causing the computer generated target picture with scoring rings 80a and scoring data 99 on monitor 100, the plunger 86 strikes the end of rod 16 and produces the recoil and recocks the hammer.

In the event that the marksman does not stand close enough for the plunger 86 to hit the rod 16, he can move the gun forward so that he will be assured that the rod will be engaged the next time of firing. Thus, if the trigger was not cocked due to the marskman not standing close enough, it can be cocked by holding the gun up to the plunger and pushing the switch 110, thus bypassing the computer and a display on the computer monitor 100.

According to the invention, the simulated marksman target training practice apparatus is designed for convenience in training marksman competitors or anyone else who desires to learn marksmanship and particularly how to most effectively hold a given sight picture and squeeze the trigger for maximum score on a target. The apparatus utilizes the sight picture at the instant the cartridge would fire in a normal gun at the sole determination of determining the point of impact of a fired projectile. The computer 98 places the point of impact, as indicated by the operator's sight picture, on a target grid for display on the monitor 100. The gun 10 can be substantially true to life in its shape and trigger function, for example an M14 military rifle, and with the use of the recoil producing plunger 86, a simulated recoil is provided. Also the computer can be programmed to generate a rather sharp but not deafening noise through a speaker or headset for simulating to some extent the noise of a gun. If desired, the line of sight 112 may include a telescope for the purpose of training to shoot with a telescope. The present system does not require any material expenses to operate, as compared to actual gun range firing. It can be used indoors with very little space and the audio and recoil characteristics of an actual gun are duplicated but importantly controlled to desired levels. Furthermore, the present system provides computer analysis and recording for grading if desired.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A video target training apparatus for marksmen comprising:

a gun-resembling member having a stock, a barrel-like portion on the stock having a forward end, trigger means for firing said gun-resembling member, a front sight on said barrel-like portion, a targer separate from said gun resembling member and disposed in closely spaced relation next to and not more than two inches from the forward end of said barrel-like portion, an optical system on said gun-resembling member including a rear side arranged to reflect a combined image of said target and said front side when said gun-resembling member is aimed at said target in said closely adjacent relation to the target, a video camera receiving said target and front sight image, electric circuit, monitor means in said electric circuit for showing said combined image of said target and said front sight, and display means in said electric circuit for receiving said target and front sight image from said camera and for causing said combined image to be displayed visually on said monitor means and powered plunger means on said target which faces the forward end of said barrel-like portion and spaces in physically separate relation from said gun-resembling member and which is operated by said switch means and arranged to forcefully strike said forward end of said barrel-like portion when said trigger means is pulled, to provide a simulated recoil and said gun-resembling member, said powered plunger means disposed under and immediately adjacent said target, whereby said plunger means provides said striking force against said forward end of said barrel-like portion.

2. The practice apparatus of claim 1 wherein said video camera is mounted on said gun resembling member.

3. The practice apparatus of claim 1 wherein said video camera is enclosed in the stock of said gun resembling member.

4. The practice apparatus of claim 1 wherein said video camera is enclosed in the stock of said gun resembling member, and opening means in said stock allowing said image to reach said enclosed camera.

5. The practice apparatus of claim 1 including display means in said circuit for receiving said simulafted target image and accurately displaying a graphic image of impact points of said sighting means relative to said simulated target image.

6. A marksman training and target practice apparatus comprising:

a gun-resembling member having a stock, a barrel-like portion on said stock having a forward end, a spring-pressed trigger recocking rod in said barrel-like portion having a front end projecting from the forward end of said barrel-like portion, a target having aiming points and being disposed immediately adjacent to the forward end of said barrel like portion, sighting means on said gun-resembling member arranged to reflect an image of said target for viewing, and powered plunger means on said target arranged to be released forcefully and strike said rod when said trigger on the gun-resembling member is pulled whereby to provide a simulated recoil and to recock the trigger.

7. The practice apparatus of claim 6 including a shock absorbing tip on the front end of said rod.

8. A video target training apparatus for marksmen comprising:

a gun-resembling member having a stock, a barrel-like portion on the stock having a forward end, trigger means for firing said gun-resembling member, a front sight on said barrel-like portion, a target immediately adjacent to and not more than two inches from the forward end of said barrel-like portion, an optical system on said gun-resembling member including a rear sight arranged to reflect a combined range of said target and said front sight when said gun resembling member is aimed at said target in said immediately adjacent position, a video camera receiving said target and said front sight image, electric circuit, monitor means in said electric circuit for showing said combined image of said target and said front sight, display means in said electric circuit for receiving said target and front sight image from said camera and for causing said combiner image to be displayed visually on said monitor means, frame grabber means in said electric circuit arranged to hold several frames and display a single frame on said monitor means, switch means in said electric circuit associated with said trigger means for activating said frame grabber means when said trigger means is pulled, and powered plunger means on said target which faces the forward end of said barrel-like portion and spaced in physically separate relation from said gun-resembling member and which is operated by said switch means and arranged to forcefully strike said forward end of said barrel-like portion when said trigger means is pulled, to provide a simulated recoil in said gun resembling member said power plunger means disposed under and immediately adjacent said target, whereby said plunger means provides said striking force against said barrel-like portion.

9. The practice apparatus of claim 8 wherein said powered plunger means comprises an electrically operated fluid driven plunger, a spring-pressed trigger recocking rod in said barrel-like portion having a front end projecting from the forward end of said barrel-like portion, and bypass circuit means including said powered plunger means and activating means adjacent said trigger means whereby said activating means is arranged to operate said powered plunger means when said bypass circuit means is energized to strike said rod and re-cock the trigger means without activating said video camera.

10. A video target training apparatus for marksmen comprising:

a gun-resembling member having a stock, a barrel-like portion on the stock having a forward end, trigger means for firing said gun-resembling member, a front sight on said barrel-like portion, a target immediately adjacent to and not more than two inches from the forward end of said barrel-like portion, an optical system on said gun-resembling member including a rear sight arranged to reflect a combined image of said target and said front sight when said gun-resembling member is aimed at said target in said immediately adjacent position, a video camera receiving said target and said front sight image, electric circuit, monitor means in said electric circuit for showing said combined image of said target and said front sight, display means in said electric circuit for receiving said target and front sight image from said camera and for causing said combined image to be displayed visually on said monitor means, switch means in said electric circuit associated with said trigger means for activating said display means when said trigger means is pulled, an elongated rod extending through said barrel-like portion and having a forward end projecting from said barrel-like portion and a rearward end operably associated with said trigger means, and powered plunger means on said target operated by said switch means and arranged to forcefully strike said rod when said trigger means is pulled, whereby to provide a simulated recoil in said gun resembling member and also to re-cock the trigger means.

* * * * *